US009765678B2

(12) United States Patent
Morishita et al.

(10) Patent No.: US 9,765,678 B2
(45) Date of Patent: Sep. 19, 2017

(54) HEAT-RESISTANT, AUSTENITIC CAST STEEL HAVING EXCELLENT MACHINABILITY AND EXHAUST MEMBER MADE THEREOF

(71) Applicant: HITACHI METALS, LTD., Tokyo (JP)

(72) Inventors: Kana Morishita, Matsue (JP); Kenichi Inoue, Matsue (JP); Susumu Katsuragi, Moka (JP); Masahide Kawabata, Moka (JP); Tomonori Sakuta, Miyako-gun (JP)

(73) Assignee: HITACHI METALS, LTD., Tokyo (JP)

( * ) Notice: Subject to any disclaimer, the term of this patent is extended or adjusted under 35 U.S.C. 154(b) by 275 days.

(21) Appl. No.: 14/399,648

(22) PCT Filed: May 9, 2013

(86) PCT No.: PCT/JP2013/063045
§ 371 (c)(1),
(2) Date: Nov. 7, 2014

(87) PCT Pub. No.: WO2013/168770
PCT Pub. Date: Nov. 14, 2013

(65) Prior Publication Data

US 2015/0086412 A1 Mar. 26, 2015

(30) Foreign Application Priority Data

May 10, 2012 (JP) ..... 2012-108192

(51) Int. Cl.

| | |
|---|---|
| ***F01N 13/16*** | (2010.01) |
| ***C22C 38/00*** | (2006.01) |
| ***C22C 38/60*** | (2006.01) |
| ***C22C 38/02*** | (2006.01) |
| ***C22C 38/04*** | (2006.01) |
| ***C22C 38/06*** | (2006.01) |
| ***C22C 38/34*** | (2006.01) |
| ***C22C 38/44*** | (2006.01) |
| ***C21D 6/00*** | (2006.01) |
| ***C22C 30/00*** | (2006.01) |
| ***C22C 38/48*** | (2006.01) |

(52) U.S. Cl.
CPC ..... *F01N 13/16* (2013.01); *C21D 6/004* (2013.01); *C22C 30/00* (2013.01); *C22C 38/00* (2013.01); *C22C 38/001* (2013.01); *C22C 38/02* (2013.01); *C22C 38/04* (2013.01); *C22C 38/06* (2013.01); *C22C 38/34* (2013.01); *C22C 38/44* (2013.01); *C22C 38/48* (2013.01); *C22C 38/60* (2013.01); *F01N 2530/04* (2013.01)

(58) Field of Classification Search
CPC ..... F01N 13/16; F01N 2530/04; C22C 30/00; C22C 38/00; C22C 38/001; C22C 38/02; C22C 38/04; C22C 38/06; C22C 38/34; C22C 38/44; C22C 38/48; C22C 38/60; C21D 6/004
See application file for complete search history.

(56) References Cited

U.S. PATENT DOCUMENTS

| | | | |
|---|---|---|---|
| 8,241,558 | B2 | 8/2012 | Hayashi et al. |
| 2007/0217941 | A1 | 9/2007 | Hayashi et al. |

FOREIGN PATENT DOCUMENTS

| | | | |
|---|---|---|---|
| EP | 2 003 221 | A1 | 12/2008 |
| WO | 2005/103314 | A1 | 11/2005 |
| WO | 2007/116913 | A1 | 10/2007 |

OTHER PUBLICATIONS

International Search Report for PCT/JP2013/063045 dated Aug. 6, 2013.

*Primary Examiner* — Roy King
*Assistant Examiner* — Caitlin Kiechle
(74) *Attorney, Agent, or Firm* — Sughrue Mion, PLLC

(57) ABSTRACT

A heat-resistant, austenitic cast steel having excellent machinability comprising by mass 0.4-0.55% of C, 1-2% of Si, 0.5-1.5% of Mn, 18-27% of Cr, 8-22% of Ni, 1.5-2.5% of Nb, 0.01-0.3% of N, 0.1-0.2% of S, and 0.02-0.15% of Al, the balance being Fe and inevitable impurities, a machinability index I represented by the following formula: $I=100\times S+75\times Al+0.75\times Mn-10\times C-2\times Nb-0.25\times Cr-0.15\times Ni-1.2\times N$, wherein each element symbol represents % by mass of each element in the cast steel, meeting the condition of $-3.0\leq I\leq +14.0$, and an exhaust member made thereof.

4 Claims, 1 Drawing Sheet

HEAT-RESISTANT, AUSTENITIC CAST STEEL HAVING EXCELLENT MACHINABILITY AND EXHAUST MEMBER MADE THEREOF

CROSS REFERENCE TO RELATED APPLICATIONS

This application is a National Stage of International Application No. PCT/JP2013/063045 filed May 9, 2013 (claiming priority based on Japanese Patent Application No. 2012-108192 filed May 10, 2012), the contents of which are incorporated herein by reference in their entirety.

FIELD OF THE INVENTION

The present invention relates to a heat-resistant cast steel suitable for exhaust members, etc. of gasoline engines and diesel engines of automobiles, particularly to heat-resistant, austenitic cast steel having excellent machinability, and an exhaust member made thereof.

BACKGROUND OF THE INVENTION

For the purpose of environmental load reduction and environmental protection recently needed on a global scale, the cleaning of exhaust gases for reducing the emission of air-polluting materials, and the improvement of fuel efficiency (low fuel consumption) for suppressing the emission of $CO_2$, a cause of global warming, are strongly required in automobiles. To clean exhaust gases, and to improve fuel efficiency in automobiles, various technologies such as the development of engines with high performance and fuel efficiency, the cleaning of exhaust gases, the weight reduction of car bodies, the air resistance reduction of car bodies, efficient power transmission from engines to driven systems with low loss, etc. have been developed and employed.

Technologies for providing engines with high performance and improving their fuel efficiency include the direct injection of fuel, increase in compression ratios, decrease in displacements by turbochargers, the reduction of engine weights and sizes (downsizing), etc., and are used not only in luxury cars but also in popular cars. As a result, fuel combustion tends to occur at higher temperatures and pressure, resulting in higher-temperature exhaust gases discharged from combustion chambers of engines. For example, the temperatures of exhaust gases are 1000° C. or higher even in popular cars, like luxury sport cars, so that the surface temperatures of exhaust members tend to exceed 950° C. Because exhaust members exposed to high-temperature oxidizing gases are subjected to repeated heating/cooling cycles by the start and stop of engines in a severer oxidizing environment than ever, they are required to have higher heat resistance such as oxidation resistance, high-temperature strength, thermal fatigue life, etc. than ever.

Exhaust members such as exhaust manifolds, turbine housings, etc. used for gasoline engines and diesel engines of automobiles have conventionally been formed by castings with high freedom of shape, because of their complicated shapes. In addition, because of their severe, high-temperature use conditions, heat-resistant, cast irons such as high-Si, spheroidal graphite cast irons and Niresist cast irons (Ni—Cr-containing, austenitic cast irons), heat-resistant, cast ferritic steels, heat-resistant, austenitic cast steels, etc. are used.

However, conventional, heat-resistant, cast irons such as high-Si, spheroidal graphite cast irons and Niresist cast irons exhibit low strength and low heat resistance such as oxidation resistance and thermal fatigue life in environment exposed to exhaust gases at higher than 900° C., despite relatively high strength when exhaust gases are at 900° C. or lower, and exhaust members are at about 850° C. or lower. The heat-resistant, cast ferritic steel is usually poor in high-temperature strength at 900° C. or higher.

As a material that can withstand higher temperatures than heat-resistant, cast irons and heat-resistant, cast ferritic steels, there is a heat-resistant, austenitic cast steel. For example, WO 2005/103314 proposes a high-Cr, high-Ni, heat-resistant, austenitic cast steel comprising by weight 0.2-1.0% of C, 3% or less of Si, 2% or less of Mn, 0.5% or less of S, 15-30% of Cr, 6-30% of Ni, 0.5-6% of W and/or Mo (as W+2 Mo), 0.5-5% of Nb, 0.01-0.5% of N, 0.23% or less of Al, and 0.07% or less of O, the balance being substantially Fe and inevitable impurities. Because this heat-resistant, austenitic cast steel has high high-temperature yield strength, oxidation resistance and room-temperature elongation, and an excellent thermal fatigue life particularly when exposed to an exhaust gas at a high temperature of 1000° C. or higher, it is suitable for exhaust members, etc. of automobile engines.

Because cast exhaust members are subjected to machining such as cutting in connecting portions such as surfaces attached to engines and their surrounding parts and mounting holes, portions needing dimensional precision, etc., and then assembled in automobiles, they should have high machinability. However, heat-resistant cast steels used for exhaust members are generally difficult-to-cut materials having poor machinability. Particularly heat-resistant, austenitic cast steels comprising much Cr and Ni for high strength are poor in machinability. Accordingly, when exhaust members made of a heat-resistant, austenitic cast steel are cut, relatively expensive cutting tools having high hardness and strength are needed, and frequent tool exchange is necessary because of a short tool life, resulting in high machining cost, and long cutting time because of a low cutting speed, resulting in low machining efficiency because cutting needs a long period of time. Thus, exhaust members made of the heat-resistant, austenitic cast steel suffer low productivity and economy in machining. From the aspect of machinability, it has been found that the heat-resistant, austenitic cast steel of WO 2005/103314 has room to be improved.

OBJECT OF THE INVENTION

Accordingly, an object of the present invention is to provide a heat-resistant, austenitic cast steel having excellent heat resistance at around 1000° C. and excellent machinability, and an exhaust member made of such a heat-resistant, austenitic cast steel.

DISCLOSURE OF THE INVENTION

As a result of intensive research conducted on the heat-resistant, austenitic cast steel of WO 2005/103314 in view of the above object, the inventors have found that by adding desired amounts of Al and S to this heat-resistant, austenitic cast steel, with the amounts of C, Mn, Cr, Ni, Nb and N limited to proper ranges, its machinability can be improved while keeping excellent heat resistance at around 1000° C. The present invention has been completed based on such finding.

Thus, the heat-resistant, austenitic cast steel of the present invention having excellent machinability comprises by mass 0.4-0.55% of C,
1-2% of Si,
0.5-1.5% of Mn,
18-27% of Cr,
8-22% of Ni,
1.5-2.5% of Nb,
0.01-0.3% of N,
0.1-0.2% of S, and
0.02-0.15% of Al,
the balance being Fe and inevitable impurities, a machinability index I represented by the following formula:

$$I=100\times S+75\times Al+0.75\times Mn-10\times C-2\times Nb-0.25\times Cr-0.15\times Ni-1.2\times N,$$

wherein each element symbol represents % by mass of each element in the cast steel, meeting the condition of $-3.0\leq I\leq +14.0$.

The heat-resistant, austenitic cast steel of the present invention may further contain by mass 0.5-3.2% by mass of W and/or Mo (as W+2 Mo).

The heat-resistant, austenitic cast steel of the present invention preferably has a structure, in which the area ratio of sulfide particles having equivalent circle diameters of 2 μm or more to all sulfide particles is 60% or more.

When the heat-resistant, austenitic cast steel of the present invention is milled with a cemented carbide tool at a cutting speed 150 m/minute, a feed of 0.2 mm/tooth, and a cutting depth of 1.0 mm, under a dry condition without a cutting liquid, a tool life expressed by cutting time until the flank wear of the cemented carbide tool reaches 0.2 mm is preferably 25 minutes or more.

The exhaust member of the present invention is made of the above heat-resistant, austenitic cast steel. Preferred examples of such exhaust members include an exhaust manifold, a turbine housing, a turbine-housing-integrated exhaust manifold, a catalyst case, a catalyst-case-integrated exhaust manifold, and an exhaust outlet.

DESCRIPTION OF THE PREFERRED EMBODIMENTS

[1] Heat-resistant, Austenitic Cast Steel

Figure 1:
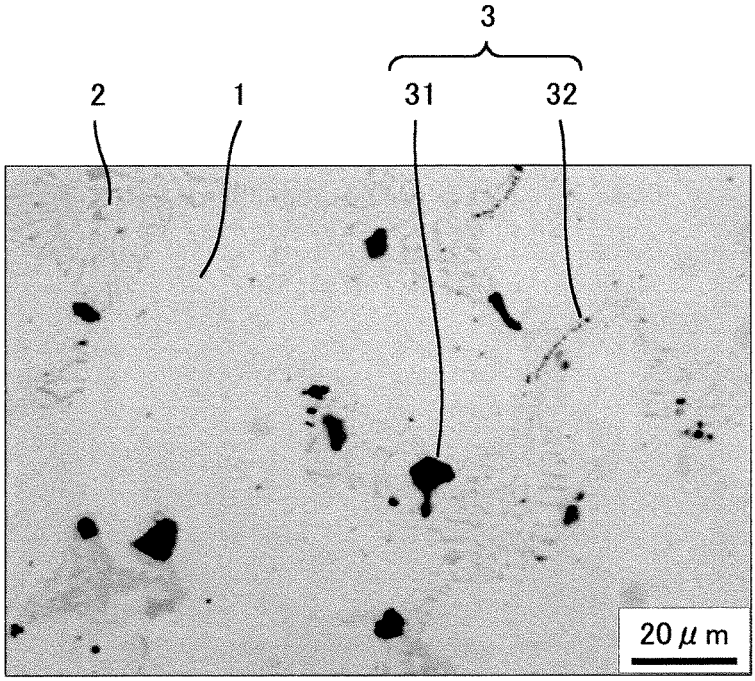
FIG. 1 is an optical photomicrograph showing the microstructure of the heat-resistant, austenitic cast steel of Example 8.

The composition and structure of the heat-resistant, austenitic cast steel of the present invention will be explained in detail below. The amount of each element constituting the alloy is expressed by "% by mass" unless otherwise mentioned.

(A) Composition (1) C (Carbon): 0.4-0.55%

C has (a) a function of improving the fluidity (castability) of a melt, (b) a function of solid solution strengthening by partial dissolving in the matrix, (c) a function of improving high-temperature strength by the formation of Cr carbides, and (d) a function of improving the castability and high-temperature strength of the heat-resistant cast steel by the formation of eutectic Nb carbides. To exhibit such functions effectively, C should be 0.40% or more. However, more than 0.55% of C provides too much crystallized carbides and precipitated carbides, providing the heat-resistant cast steel with low ductility and deteriorated machinability. Accordingly, the C content is 0.4-0.55%. The C content is preferably 0.42-0.52%.

(2) Si (Silicon): 1-2%

Si is an element not only functioning as a deoxidizer of the melt, but also providing the resultant heat-resistant cast steel with improved oxidation resistance and thus an improved thermal fatigue life. To obtain such functions, the Si content should be 1% or more. However, excessive Si makes an austenite structure unstable, and provides the heat-resistant cast steel with deteriorated castability, and further machinability deteriorated by hardening. Accordingly, the Si content should be 2% or less. Accordingly, the Si content is 1-2%. The Si content is preferably 1.25-1.8%, more preferably 1.3-1.6%.

(3) Mn (Manganese): 0.5-1.5%

Mn is not only effective as a deoxidizer of the melt like Si, but also combined with S to form sulfide particles MnS, thereby improving the machinability of the heat-resistant cast steel. To exhibit these effects, the Mn content should be 0.5% or more. However, because excessive Mn deteriorates oxidation resistance, the Mn content should be 1.5% or less. Accordingly, the Mn content is 0.5-1.5%.

(4) Cr (Chromium): 18-27%

Cr provides the heat-resistant cast steel with improved high-temperature strength and oxidation resistance like Ni as described below, improved heat resistance by its carbides, and improved machinability due to the formation of composite sulfide particles (Cr/Mn)S with Mn and S. Particularly, to improve heat resistance in a high temperature range of around 1000° C., and machinability, 18% or more of Cr should be contained. However, the inclusion of more than 27% of Cr provides too much crystallized carbides, thereby providing the heat-resistant cast steel with extremely deteriorated machinability, and ductility and toughness lowered by embrittlement. Also, excessive Cr crystallizes ferrite in the structure, providing the heat-resistant cast steel with low high-temperature strength. Accordingly, the Cr content is 18-27%. From the aspect of machinability, the preferred Cr content is 18-22%.

(5) Ni (Nickel): 8-22%

Ni is an austenite-forming element, stabilizing an austenite structure in the heat-resistant cast steel, improving the high-temperature strength and oxidation resistance of the heat-resistant cast steel like Cr, and improving the castability of thin exhaust members having complicated shapes. To exhibit such functions effectively, the Ni content should be 8% or more. However, when more than 22% of Ni is contained, the amount of Ni dissolved in the matrix increases, providing the heat-resistant cast steel with higher hardness and low machinability. Accordingly, the Ni content is 8-22%. From the aspect of machinability, the preferred Ni content is 8-12%.

(6) Nb (Niobium): 1.5-2.5%

Nb not only suppresses the formation of Cr carbides to indirectly improve oxidation resistance and machinability, but also is combined with C to form fine carbides, thereby providing the heat-resistant cast steel with improved high-temperature strength and thermal fatigue life. Also, eutectic carbides of austenite and Nb carbide (NbC) improve the castability of thin castings having complicated shapes such as exhaust members. For such purposes, the Nb content should be 1.5% or more. However, excessive Nb forms too much hard eutectic carbides in crystal grain boundaries, rather deteriorating machinability, and extremely decreasing strength and ductility by embrittlement. Accordingly, the Nb content should be 1.5-2.5%.

(7) N (Nitrogen): 0.01-0.3%

N is a strong austenite-forming element, which provides the heat-resistant cast steel with a stabilized austenitic matrix and thus improved high-temperature strength. N is also an element effective for making crystal grains finer in castings of complicated shapes, which cannot be forged or rolled to make crystal grains finer. Finer crystal grains provide improved ductility and machinability. Further, because N reduces the diffusion speed of C, it retards the agglomeration of precipitated carbides, thereby suppressing the formation of coarse carbides, and thus effectively preventing embrittlement. To obtain such effects, the N content should be 0.01% or more. However, when more than 0.3% of N is contained, an increased amount of N is not only dissolved in the matrix, resulting in a hard, heat-resistant, cast steel, but also combined with Cr and Al to precipitate large amounts of hard, brittle nitrides such as $Cr_2N$, AlN, etc., resulting in rather low machinability. Also, these nitrides act as starting cites of cracking and breakage, deteriorating strength and ductility. Further, excessive N accelerates the generation of gas defects such as pinholes, blowholes, etc. during casting, resulting in a decreased casting yield. Accordingly, the N content is 0.01-0.3%, preferably 0.06-0.25%.

(8) S (Sulfur): 0.1-0.2%

S is an important element for improving the machinability of the heat-resistant, austenitic cast steel of the present invention. S is combined with Mn and Cr to form sulfide particles such as MnS, (Cr/Mn)S, etc., thereby improving the machinability of the heat-resistant cast steel. It has been conventionally known that spherical or granular sulfide particles improve the machinability of the heat-resistant cast steel by a lubricating function and a chip-dividing function during cutting, and the present invention combines the machinability-improving function of S with the machinability-improving function Al as described later, thereby drastically improving the machinability. To obtain this effect, S should be 0.1% or more. However, more than 0.2% of S tends to deteriorate high-temperature strength and ductility. Accordingly, the S content is 0.1-0.2%, preferably 0.12-0.18%.

(9) Al (Aluminum): 0.02-0.15%

Al is an important element for improving the machinability of the heat-resistant, austenitic cast steel of the present invention. For example, when the heat-resistant cast steel is cut by a tool, Al dissolved in the matrix of the heat-resistant cast steel is reacted with oxygen in the air, etc. by heat generated by cutting, forming $Al_2O_3$, a high-melting-point oxide, on the heat-resistant cast steel surface. $Al_2O_3$ acts as a protective layer, preventing a tool from being welded to a work, thereby expanding a tool life. To prevent the welding of a work to a tool by forming a protective layer with Al, 0.02% or more of Al should be added. However, $Al_2O_3$ and AlN formed in a melt prepared with more than 0.15% of Al remain in the heat-resistant cast steel as inclusions. $Al_2O_3$ accelerates the formation of casting defects such as slug inclusion, resulting in a poor casting yield. Because AlN is hard and brittle, it rather deteriorates the machinability. In addition, these oxide and nitride act as starting cites of cracking and breakage, deteriorating high-temperature strength and ductility. Accordingly, the Al content is 0.02-0.15%, preferably 0.04-0.10%, more preferably 0.04-0.08%.

(10) Machinability Index (I): −3.0 to +14.0

The present invention requires not only that the constituent elements meet the above composition ranges, but also that a machinability index I represented by the following formula:

$$I=100\times S+75\times Al+0.75\times Mn-10\times C-2\times Nb-0.25\times Cr-0.15\times Ni-1.2\times N,$$

wherein each element symbol represents % by mass of each element in the cast steel, meets the condition of $-3.0\leq I\leq +14.0$.

It has been found that the machinability of the heat-resistant, austenitic cast steel of the present invention is achieved not by containing any one of S and Al, but by containing both of them. This reason is not necessarily clear, but it is presumed that sulfide particles such as MnS, etc. formed in the heat-resistant cast steel have high ductility and lubrication, and that $Al_2O_3$ formed by temperature elevation during cutting has a tool-protecting function. MnS and $Al_2O_3$ having good affinity to each other form a good composite surface layer having lubricating and protecting functions, suppressing the welding of a work to a tool by direct contact, and reducing cutting resistance to suppress the wear of a tool, thereby drastically improving the machinability and expanding a tool life. Thus, by limiting the S, Al and Mn contents to the above ranges, and by optimizing their total amount, the heat-resistant, austenitic cast steel of the present invention sufficiently provided with a lubricating, protective composite layer exhibits excellent machinability.

It has also been found that when the total amount of C, Nb, Cr, Ni and N is excessive, the heat-resistant cast steel tends to have low machinability. Specifically, larger amounts of C, Nb and Cr provide more carbides, a larger amount of Ni hardens the alloy, and a larger amount of N not only hardens the alloy but also provides more nitrides. Thus, any of them deteriorates the machinability of the heat-resistant cast steel. The present invention is characterized by limiting each of C, Nb, Cr, Ni and N to the above composition range, and further adjusting their total amount to a desired range, to suppress the deterioration of the machinability of the heat-resistant cast steel. Incidentally, though a larger amount of Si deteriorates the machinability of the heat-resistant cast steel like the above five elements, Si is not included in the machinability index, because the influence of Si on machinability is negligibly small in the composition range of the present invention.

To improve machinability by a lubricating, protective, composite layer by adjusting the total amount of S, Al and Mn, and to suppress the deterioration of machinability by adjusting the total amount of C, Nb, Cr, Ni and N, the degree of influence of eight elements of S, Al, Mn, C, Nb, Cr, Ni and N on machinability has been investigated in detail. As a result, it has been found that when the machinability index I represented by $100\times S+75\times Al+0.75\times Mn-10\times C-2\times Nb-0.25\times Cr-0.15\times Ni-1.2\times N$ is in a range of −3.0 to +14.0, sufficient machinability is secured. Of course, even though I were in a range of −3.0 to +14.0, sufficient machinability would not be secured if the amount of each element were outside the desired range. The preferred range of I is 2.0-8.0.

As an evaluation standard of the machinability of the heat-resistant, austenitic cast steel, the life of a cemented carbide tool used for cutting is used. In cutting with a cemented carbide tool, when a tool life on the heat-resistant, austenitic cast steel of the present invention is 1.6 times or more the tool life (15 minutes) on the heat-resistant, austenitic cast steel described in WO 2005/103314 (Comparative Example 26), it is judged that the heat-resistant, austenitic cast steel of the present invention has excellent machinability. The tool life is represented by cutting time until the flank wear of a cemented carbide tool reaches 0.2 mm, when dry milling is conducted with the cemented carbide tool at a cutting speed of 150 m/minute, a feed of 0.2 mm/tooth, and a cutting depth of 1.0 mm, without a cutting liquid.

(11) W (Tungsten) and/or Mo (Molybdenum): Preferably 0.5-3.2% (as W+2Mo)

Because both W and Mo are elements improving the high-temperature strength of the heat-resistant cast steel, W and/or Mo may be added in a range not deteriorating the machinability, to improve the heat-resistant, austenitic cast steel of the present invention. However, the addition of excessively W and/or Mo deteriorates the oxidation resistance and machinability of the heat-resistant cast steel. Because the addition effect of Mo is two times that of W, the amount of W and/or Mo is expressed by W+2 Mo (by mass). Accordingly, when W is added alone, W is preferably 0.5-3.2%, more preferably 0.8-3.0%, most preferably 1.0-2.5%. When Mo is added alone, Mo is 0.25-1.6%, more preferably 0.4-1.5%, most preferably 0.5-1.25%. When both W and Mo are added, W+2 Mo is preferably 0.5-3.2%, more preferably 0.8-3.0%, most preferably 1.0-2.5%.

(12) Inevitable Impurities

An inevitable impurity contained in the heat-resistant, austenitic cast steel of the present invention is mostly P coming from a starting material. Because P is segregated in crystal grain boundaries to reduce toughness extremely, the amount of P is preferably as small as possible. Specifically, P is preferably 0.04% or less.

(B) Structure (1) Area Ratio of Sulfide Particles Having Equivalent Circle Diameters of 2 μm or More to all Sulfide Particles: 60% or More As more large sulfide particles are crystallized in the structure of the heat-resistant, austenitic cast steel of the present invention, the heat-resistant, austenitic cast steel tends to have higher machinability, and a tool used for cutting the heat-resistant, austenitic cast steel tends to have a longer life. A sulfide particle having an equivalent circle diameter of 2 μm or more is regarded as a large sulfide particle. The equivalent circle diameter of a sulfide particle is defined as a diameter of a circle having the same area as that of a sulfide particle. To further improve the machinability, the area ratio of sulfide particles having equivalent circle diameters of 2 μm or more to all sulfide particles is preferably 60% or more, more preferably 70% or more, most preferably 80% or more. Though not particularly restricted, the upper limit of the area ratio of sulfide particles having equivalent circle diameters of 2 μm or more is about 95% in the composition range of the present invention. Because sulfide particles are crystallized with Al oxides as nuclei, both Al and S should be added to the heat-resistant, austenitic cast steel of the present invention containing a relatively large amount of Nb, with the amounts of alloy elements limited in the range defined by the present invention, to achieve that the area ratio of sulfide particles having equivalent circle diameters of 2 μm or more is 60% or more.

The machinability is presumably improved by a mechanism described below, when the area ratio of sulfide particles having equivalent circle diameters of 2 μm or more is 60% or more. In the heat-resistant, austenitic cast steel of the present invention containing as much as 1.5-2.5% of Nb, large amounts of carbides and nitrides such as NbC, NbN, etc. are formed when solidified, and 20% or more by area of eutectic Nb carbide is also formed. Carbides and nitrides of Nb function as nuclei for uniformly crystallizing sulfide particles such as MnS, (Cr/Mn)S, etc., and uniformly dispersed sulfide particles improve the machinability. It has been found that such effects are obtained on steels such as structural steel, free-cutting steel, etc., which contain at most about 0.5% of Nb, but not on steels containing more than 0.5% of Nb. Why machinability-improving effects are not obtained on steels containing more than 0.5% of Nb is presumably due to the fact that because large amounts of carbides and nitrides of Nb formed in steel containing more than 0.5% of Nb are used as nuclei for crystallizing fine sulfide particles, which are segregated in a eutectic state with carbides and nitrides of Nb, uniformly dispersed sulfide particles of proper size are not obtained, resulting in a small lubricating function and a small chip-dividing function during cutting.

On the other hand, even a trace amount of Al forms oxides such as $Al_2O_3$, etc. functioning as crystallization nuclei for sulfide particles such as MnS. Because Al oxides tends to be agglomerated to coarser particles in the melt, large sulfide particles are also crystallized with the Al oxides as nuclei. The existence of large numbers of large sulfide particles contributes to improvement in the machinability. Because the heat-resistant, austenitic cast steel of the present invention contains Al together with a relatively large amount of Nb, large amounts of large sulfide particles are crystallized by the formation of coarse Al oxides, which have a larger function of forming sulfide particles than that of the carbides and nitrides of Nb. Thus, in the heat-resistant, austenitic cast steel of the present invention containing Nb and Al, the segregation of fine sulfide particles crystallized with the carbides and nitrides of Nb as nuclei is suppressed, and as large sulfide particles as having equivalent circle diameters of 2 μm or more crystallized with the Al oxides as nuclei are uniformly dispersed to effectively exhibit lubricating and chip-dividing functions during cutting, resulting in improved machinability. Incidentally, the formation of uniformly dispersed coarse sulfide particles by Al oxides differs from a function of protecting a tool by $Al_2O_3$, a high-melting-point oxide formed from Al in the matrix by heat generated during cutting.

As described above, the heat-resistant, austenitic cast steel of the present invention containing both S and Al, has drastically improved machinability, due to the lubricating function of sulfide particles, the tool-protecting-function of high-melting point Al oxides formed during cutting, and Al oxides' function of uniformly dispersing coarse sulfide particles.

[2] Tool Life

The machinability of the heat-resistant, austenitic cast steel of the present invention is expressed by cutting time until the flank wear of a cemented carbide tool used reaches 0.2 mm, when milling is conducted at a cutting speed of 150 m/minute, a feed of 0.2 mm/tooth and a cutting depth of 1.0 mm in a dry state without using a cutting liquid. The tool life is preferably 25 minutes or more. Casting members are rarely used in an as-cast state, and subjected to machining such as end milling, lathe turning, drilling, etc. For example, exhaust manifolds are milled in flanges connected to cylinder heads and turbine housings of engines, and drilled to have mounting holes. It is said that difficult-to-cut materials such as heat-resistant, austenitic cast steel have excellent machinability, when their tool lives are 25 minutes or more in milling under the above cutting conditions. In the heat-resistant, austenitic cast steel of the present invention, the above tool life is further preferably 30 minutes or more, more preferably 40 minutes or more, most preferably 50 minutes or more.

[3] Exhaust Member

The exhaust member of the present invention is made of the heat-resistant, austenitic cast steel of the present invention having excellent machinability. Preferred examples of the exhaust members are exhaust manifolds, turbine housings, turbine-housing-integrated exhaust manifolds, catalyst cases, catalyst-case-integrated exhaust manifolds, and exhaust outlets, though not restrictive.

The exhaust member of the present invention exhibits high heat resistance, even when its surface temperature reaches 950-1000° C. by exposure to a high-temperature exhaust gas at 1000° C. or higher. Further, the exhaust member of the present invention exhibits high machining productivity and efficiency, and can be produced at low cost, because of excellent machinability. Accordingly, it makes it possible to apply the technologies of improving the performance and fuel efficiency of engines to popular cars, contributing to cleaning exhaust gases and improving the fuel efficiency of automobiles.

The present invention will be explained in more detail referring to Examples below without intention of restricting the present invention thereto. The amount of each element constituting the heat-resistant, austenitic cast steel is expressed by "% by mass" unless otherwise mentioned.

EXAMPLES 1-20, AND COMPARATIVE EXAMPLES 1-26

The chemical compositions and machinability indices I of the heat-resistant, austenitic cast steels of Examples 1-20 within the composition range of the present invention are shown in Table 1, and the chemical compositions and machinability indices I of the heat-resistant cast steels of Comparative Examples 1-26 are shown in Table 2. The cast steel of Comparative Example 5 has too small a Mn content, the cast steel of Comparative Example 7 has too small a S content, the cast steels of Comparative Examples 16 and 18 have too small Al contents, the cast steels of Comparative Examples 22 and 23 have too small I, and the cast steels of Comparative Examples 24 and 25 have too large I. Comparative Example 26 is an example of the high-Cr, high-Ni, heat-resistant, austenitic cast steels described in WO 2005/103314.

TABLE 1-1

| | Component Composition (% by mass) | | | | | |
|---|---|---|---|---|---|---|
| No. | C | Si | Mn | S | Cr | Ni |
| Example 1 | 0.44 | 1.42 | 1.05 | 0.108 | 20.5 | 9.9 |
| Example 2 | 0.55 | 1.51 | 1.00 | 0.125 | 21.7 | 11.4 |
| Example 3 | 0.48 | 1.52 | 0.98 | 0.148 | 19.9 | 9.9 |
| Example 4 | 0.47 | 1.47 | 1.02 | 0.152 | 19.8 | 10.3 |
| Example 5 | 0.48 | 1.52 | 0.98 | 0.148 | 19.9 | 9.9 |
| Example 6 | 0.47 | 1.47 | 1.02 | 0.152 | 19.8 | 10.3 |
| Example 7 | 0.45 | 1.48 | 1.04 | 0.152 | 19.8 | 10.3 |
| Example 8 | 0.44 | 1.45 | 1.10 | 0.149 | 19.6 | 9.9 |
| Example 9 | 0.45 | 1.50 | 1.00 | 0.165 | 19.5 | 10.0 |
| Example 10 | 0.42 | 1.46 | 1.05 | 0.168 | 18.6 | 8.8 |
| Example 11 | 0.49 | 1.50 | 1.02 | 0.148 | 24.8 | 19.8 |
| Example 12 | 0.48 | 1.48 | 0.95 | 0.151 | 25.4 | 19.6 |
| Example 13 | 0.43 | 1.45 | 1.00 | 0.182 | 23.8 | 18.9 |
| Example 14 | 0.40 | 1.48 | 1.00 | 0.150 | 20.5 | 10.2 |
| Example 15 | 0.47 | 1.05 | 0.99 | 0.148 | 19.8 | 10.1 |
| Example 16 | 0.49 | 1.51 | 1.01 | 0.148 | 26.8 | 21.5 |
| Example 17 | 0.44 | 1.50 | 1.38 | 0.151 | 20.0 | 8.2 |
| Example 18 | 0.52 | 1.86 | 0.65 | 0.135 | 26.2 | 21.8 |
| Example 19 | 0.43 | 1.50 | 0.62 | 0.148 | 19.8 | 10.0 |
| Example 20 | 0.46 | 1.85 | 1.00 | 0.145 | 20.0 | 10.0 |

TABLE 1-2

| | Component Composition (% by mass)[1] | | | | | | |
|---|---|---|---|---|---|---|---|
| No. | W | Mo | W + 2 Mo | Nb | Al | N | I[2] |
| Example 1 | — | — | — | 1.89 | 0.070 | 0.075 | 1.7 |
| Example 2 | — | — | — | 2.35 | 0.027 | 0.248 | −2.6 |
| Example 3 | 1.2 | 0.5 | 2.3 | 1.98 | 0.056 | 0.076 | 4.2 |
| Example 4 | — | 0.8 | 1.6 | 2.21 | 0.054 | 0.082 | 4.0 |
| Example 5 | 0.5 | — | 0.5 | 1.96 | 0.061 | 0.076 | 4.6 |
| Example 6 | 3.2 | — | 3.2 | 2.02 | 0.057 | 0.083 | 4.7 |
| Example 7 | 2.9 | — | 2.9 | 2.03 | 0.057 | 0.081 | 4.9 |
| Example 8 | — | — | — | 1.94 | 0.055 | 0.075 | 4.8 |
| Example 9 | — | — | — | 1.99 | 0.092 | 0.085 | 8.9 |
| Example 10 | — | — | — | 1.78 | 0.116 | 0.063 | 12.2 |
| Example 11 | 2.9 | — | 2.9 | 1.96 | 0.075 | 0.207 | 2.7 |
| Example 12 | — | — | — | 1.89 | 0.062 | 0.210 | 2.1 |
| Example 13 | — | — | — | 1.52 | 0.148 | 0.012 | 13.7 |
| Example 14 | — | — | — | 1.62 | 0.082 | 0.094 | 7.6 |
| Example 15 | — | — | — | 1.98 | 0.062 | 0.083 | 4.7 |
| Example 16 | — | — | — | 2.01 | 0.052 | 0.204 | 0.1 |
| Example 17 | — | — | — | 1.85 | 0.065 | 0.075 | 6.2 |
| Example 18 | — | — | — | 2.25 | 0.042 | 0.233 | −2.8 |
| Example 19 | — | — | — | 1.82 | 0.053 | 0.085 | 4.6 |
| Example 20 | — | — | — | 1.85 | 0.045 | 0.265 | 3.3 |

Note:

[1]The balance are Fe and inevitable impurities.

[2]Machinability index (I) = 100 × S + 75 × Al + 0.75 × Mn − 10 × C − 2 × Nb − 0.25 × Cr − 0.15 × Ni − 1.2 × N.

TABLE 2-1

| | Component Composition (% by mass) | | | | | |
|---|---|---|---|---|---|---|
| No. | C | Si | Mn | S | Cr | Ni |
| Com. Ex. 1 | 0.36 | 1.50 | 1.01 | 0.152 | 20.5 | 10.2 |
| Com. Ex. 2 | 0.61 | 1.52 | 0.97 | 0.153 | 20.3 | 9.8 |
| Com. Ex. 3 | 0.45 | 0.29 | 1.02 | 0.149 | 19.8 | 10.1 |
| Com. Ex. 4 | 0.45 | 2.54 | 0.98 | 0.151 | 20.2 | 10.2 |
| Com. Ex. 5 | 0.45 | 1.49 | 0.32 | 0.139 | 20.0 | 10.0 |
| Com. Ex. 6 | 0.46 | 1.50 | 2.51 | 0.150 | 20.2 | 10.2 |
| Com. Ex. 7 | 0.47 | 1.50 | 0.99 | 0.030 | 20.0 | 10.0 |
| Com. Ex. 8 | 0.45 | 1.51 | 1.03 | 0.247 | 20.2 | 10.2 |
| Com. Ex. 9 | 0.44 | 1.50 | 0.95 | 0.151 | 15.8 | 10.2 |
| Com. Ex. 10 | 0.52 | 1.48 | 1.01 | 0.149 | 30.8 | 20.2 |
| Com. Ex. 11 | 0.45 | 1.50 | 1.01 | 0.143 | 20.3 | 6.5 |
| Com. Ex. 12 | 0.52 | 1.51 | 1.03 | 0.152 | 24.8 | 23.8 |
| Com. Ex. 13 | 0.43 | 1.45 | 1.04 | 0.147 | 20.0 | 10.1 |
| Com. Ex. 14 | 0.45 | 1.50 | 0.99 | 0.150 | 19.9 | 10.0 |
| Com. Ex. 15 | 0.44 | 1.48 | 1.02 | 0.138 | 20.0 | 10.0 |
| Com. Ex. 16 | 0.45 | 1.51 | 1.05 | 0.158 | 20.0 | 10.0 |
| Com. Ex. 17 | 0.45 | 1.49 | 1.02 | 0.153 | 19.9 | 10.1 |
| Com. Ex. 18 | 0.51 | 1.52 | 0.98 | 0.147 | 24.6 | 20.1 |
| Com. Ex. 19 | 0.50 | 1.49 | 0.99 | 0.146 | 25.1 | 19.8 |
| Com. Ex. 20 | 0.45 | 1.53 | 0.97 | 0.161 | 20.0 | 10.0 |
| Com. Ex. 21 | 0.45 | 1.48 | 1.00 | 0.152 | 20.0 | 10.0 |
| Com. Ex. 22 | 0.54 | 1.48 | 0.70 | 0.121 | 23.8 | 11.8 |
| Com. Ex. 23 | 0.52 | 1.82 | 0.62 | 0.105 | 26.7 | 8.4 |
| Com. Ex. 24 | 0.43 | 1.14 | 1.40 | 0.175 | 19.0 | 11.0 |
| Com. Ex. 25 | 0.41 | 1.25 | 1.42 | 0.189 | 18.2 | 11.9 |
| Com. Ex. 26 | 0.49 | 1.35 | 1.15 | 0.154 | 24.2 | 19.0 |

TABLE 2-2

| | Component Composition (% by mass)[1] | | | | | | |
|---|---|---|---|---|---|---|---|
| No. | W | Mo | W + 2 Mo | Nb | Al | N | I[2] |
| Com. Ex. 1 | — | — | — | 1.99 | 0.054 | 0.082 | 5.4 |
| Com. Ex. 2 | — | — | — | 1.98 | 0.058 | 0.083 | 3.4 |
| Com. Ex. 3 | — | — | — | 2.02 | 0.061 | 0.084 | 4.9 |
| Com. Ex. 4 | — | — | — | 1.99 | 0.048 | 0.082 | 4.0 |
| Com. Ex. 5 | — | — | — | 2.00 | 0.062 | 0.078 | 3.6 |
| Com. Ex. 6 | — | — | — | 2.03 | 0.055 | 0.080 | 5.0 |
| Com. Ex. 7 | — | — | — | 1.99 | 0.051 | 0.075 | −8.0 |
| Com. Ex. 8 | — | — | — | 2.01 | 0.052 | 0.085 | 13.9 |

TABLE 2-2-continued

| No. | Component Composition (% by mass)[1] | | | | | | |
|---|---|---|---|---|---|---|---|
| | W | Mo | W + 2 Mo | Nb | Al | N | I[2] |
| Com. Ex. 9 | — | — | — | 1.94 | 0.061 | 0.082 | 6.3 |
| Com. Ex. 10 | — | — | — | 1.98 | 0.050 | 0.078 | −0.8 |
| Com. Ex. 11 | — | — | — | 1.95 | 0.071 | 0.076 | 5.6 |
| Com. Ex. 12 | — | — | — | 2.05 | 0.042 | 0.083 | −0.3 |
| Com. Ex. 13 | 4.1 | — | 4.1 | 1.96 | 0.052 | 0.092 | 4.3 |
| Com. Ex. 14 | — | — | — | 1.23 | 0.067 | 0.084 | 7.0 |
| Com. Ex. 15 | — | — | — | 3.24 | 0.054 | 0.081 | 0.9 |
| Com. Ex. 16 | 2.9 | — | 2.9 | 1.98 | 0.002 | 0.075 | 1.4 |
| Com. Ex. 17 | — | — | — | 1.96 | 0.180 | 0.083 | 14.3 |
| Com. Ex. 18 | — | — | — | 1.95 | 0.014 | 0.169 | −2.1 |
| Com. Ex. 19 | — | — | — | 1.85 | 0.230 | 0.174 | 14.2 |
| Com. Ex. 20 | — | — | — | 1.98 | 0.046 | 0.005 | 5.1 |
| Com. Ex. 21 | — | — | — | 1.92 | 0.048 | 0.352 | 4.0 |
| Com. Ex. 22 | — | — | — | 2.38 | 0.028 | 0.209 | −3.6 |
| Com. Ex. 23 | — | — | — | 2.10 | 0.035 | 0.287 | −4.2 |
| Com. Ex. 24 | — | — | — | 1.55 | 0.148 | 0.112 | 15.4 |
| Com. Ex. 25 | — | — | — | 1.62 | 0.137 | 0.025 | 16.2 |
| Com. Ex. 26 | 3.1 | — | 3.1 | 1.25 | 0.095 | 0.172 | 6.6 |

Note:
[1]The balance are Fe and inevitable impurities.
[2]Machinability index (I) = 100 × S + 75 × Al + 0.75 × Mn − 10 × C − 2 × Nb − 0.25 × Cr − 0.15 × Ni − 1.2 × N.

Using a 100-kg, high-frequency melting furnace with a basic lining, each starting material of Examples 1-20 and Comparative Examples 1-26 was melted in the air, charged into a ladle at 1550-1600° C., and immediately poured into a mold for casting a 1-inch Y-block and a mold for casting a cylindrical test piece for machinability evaluation at 1500-1550° C., obtaining cast steel samples.

A test piece was cut out of each sample and subjected to the following evaluations.

(1) Tool Life

An end surface of a cylindrical test piece of 96 mm in outer diameter, 65 mm in inner diameter and 120 mm in height, which was cut out of each sample, was milled by a milling machine with cemented carbide inserts coated with TiAlN by PVD, under the following conditions.

Cutting speed: 150 m/minute,
Feed: 0.2 mm/tooth,
Cutting depth: 1.0 mm,
Feeding speed: 48-152 mm/minute,
Rotation speed: 229-763 rpm, and
Cutting liquid: No (dry).

In milling each cylindrical test piece, cutting time (minutes) until the cemented carbide insert was subjected to flank wear of 0.2 mm was measured as tool life. The machinability of each cylindrical test piece is expressed by the tool life. Needless to say, the longer the tool life, the better the machinability. Table 3 shows tool lives in Examples 1-20, and Table 4 shows tool lives in Comparative Examples 1-26.

As is clear from Table 3, any test pieces of Examples 1-20 had tool lives of 25 minutes or more. As is clear from Table 4, however, the tool life was less than 25 minutes in any of the test pieces of Comparative Examples 5, 7, 16, 18 and 22-25, in which the amounts of Mn, S and Al important to form composite, lubricating, protective layers or the I values were outside the ranges of the present invention; those of Comparative Examples 2, 3, 10, 12, 13, 15 and 21 containing too much C, Si, Cr, Ni, W, Nb or N; those of Comparative Examples 9, 14 and 20 containing too little Cr, Nb or N; those of Comparative Examples 17 and 19 containing too much Al, and the conventional heat-resistant cast steel of Comparative Example 26, which is described in WO 2005/103314. This result indicated that the heat-resistant, austenitic cast steel of the present invention had good machinability.

(2) Structure

A structure-observing test piece was cut out of an end portion of each cylindrical test piece, whose machinability was evaluated, to determine an area ratio of sulfide particles having equivalent circle diameters of 2 μm or more to all sulfide particles by the following method. Each test piece was first mirror-polished, and optical photomicrographs were taken in arbitrary five fields without corrosion. In each field, the total area of all sulfide particles in an observed region of 100 μm×140 μm was determined by an image analyzer. Sulfide particles each having an equivalent circle diameter (diameter of a circle having the same area) of 2 μm or more were then identified in each observed region by an image analyzer to determine their total area. The area ratio (%) of sulfide particles having equivalent circle diameters of 2 μm or more to all sulfide particles in each observed region was calculated, and the calculated values were averaged in five fields to provide the area ratio of sulfide particles having equivalent circle diameters of 2 μm or more to all sulfide particles. The results of Examples 1-20 are shown in Table 3, and the results of Comparative Examples 1-26 are shown in Table 4. It was confirmed by analysis with an energy-dispersive X-ray analyzer attached to a field emission scanning electron microscope (FE-SEM EDS: S-4000, EDX KEVEX DELTA system available from Hitachi Ltd.) that inclusions in the structure being measured were sulfide particles such as MnS, (Cr/Mn)S, etc.

As is clear from Table 3, the area ratio of sulfide particles having equivalent circle diameters of 2 μm or more to all sulfide particles was 60% or more in Examples 1-20. Among them, the above area ratio was 70% or more in Examples 4-8, 11, 12, 14, 15, 17, 19 and 20. On the other hand, as is clear from Table 4, the above area ratio was less than 60% in any of Comparative Examples 16 and 18 having too small Al contents.

Figure 2:
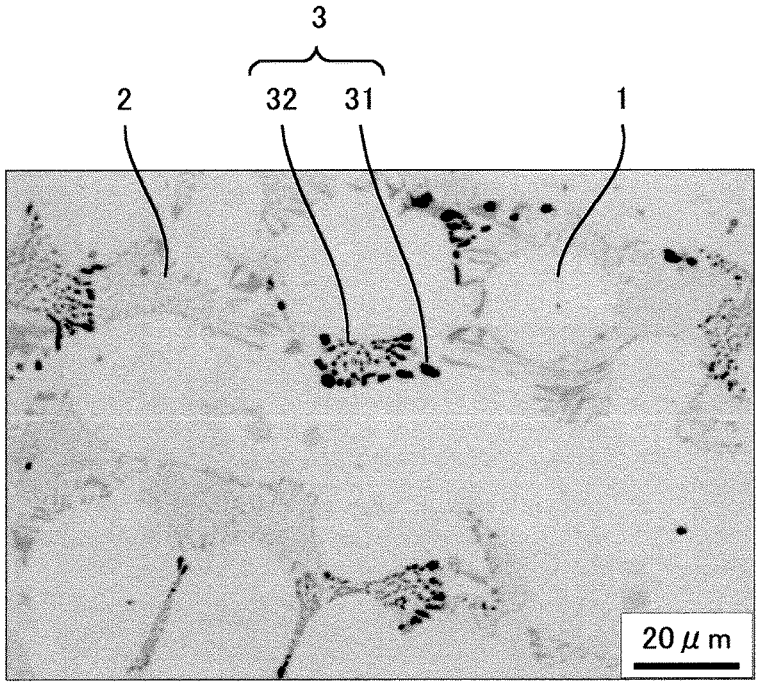
FIG. 2 is an optical photomicrograph showing the microstructure of the cast steel of Comparative Example 16.

FIG. 1 shows the microstructure of the heat-resistant, austenitic cast steel of Example 8, and FIG. 2 shows the microstructure of the cast steel of Comparative Example 16. In FIGS. 1 and 2, white portions are austenite phases 1, gray portions are lamellar eutectic Nb carbides 2, and black particles are sulfide particles 3. The sulfide particles 3 comprise large sulfide particles 31 having equivalent circle diameters of 2 μm or more, and fine sulfide particles 32 having equivalent circle diameters of less than 2 μm. In Example 8 containing Al in the range of the present invention, as shown in FIG. 1, large sulfide particles 31 were dispersed, with few fine sulfide particles 32. In Example 8, the area ratio of sulfide particles having equivalent circle diameters of 2 μm or more to all sulfide particles was 83%, and the tool life was as long as 60 minutes. In Comparative Example 16 with little Al, as shown in FIG. 2, fine eutectic sulfide particles 32 were segregated, with few large sulfide particles 31. In Comparative Example 16, the above area ratio was 46%, and the tool life was as short as 21 minutes.

(3) Weight Reduction by Oxidation

Oxide films are formed on surfaces of exhaust members exposed to exhaust gases containing oxidizing gases such as sulfur oxide, nitrogen oxide, etc. at 1000° C. or higher, which are discharged from engines. As oxidation proceeds, cracking occurs from the oxide films and propagates inside the exhaust members, and finally penetrates the exhaust members, resulting in the leakage of exhaust gases and the breakage of the exhaust members. To evaluate the oxidation resistance of an exhaust member at 1000° C., weight reduction by oxidation was determined by the following method. Namely, a round rod test piece of 10 mm in diameter and 20 mm in length was cut out of each 1-inch Y-block sample, kept at 1000° C. for 200 hours in the air, and then shot-blasted to remove oxide scales, to measure mass change per a unit area before and after the oxidation test [weight reduction by oxidation ($mg/cm^2$)]. The measurement results of weight reduction by oxidation in Examples 1-20 are shown in Table 3, and those in Comparative Examples 1-26 are shown in Table 4.

To exhibit sufficient heat resistance at around 1000° C., the weight reduction by oxidation measured by the above method is preferably 20 $mg/cm^2$ or less, more preferably 10 $mg/cm^2$ or less. As is clear from Table 3, the weight reduction by oxidation was 20 $mg/cm^2$ or less in all of Examples 1-20. This result indicates that the heat-resistant, austenitic cast steel of the present invention has excellent oxidation resistance, exhibiting sufficient oxidation resistance when used for exhaust members reaching temperatures of around 1000° C. As is clear from Table 4, the weight reduction by oxidation was more than 20 $mg/cm^2$, in any of Comparative Examples 3, 9 and 14 containing too little Si, Cr or Nb, and Comparative Example 6 and 13 containing too much Mn or W. This indicates that the cast steels of Comparative Examples 3, 6, 9, 13 and 14 fail to exhibit sufficient oxidation resistance when used for exhaust members reaching temperatures of around 1000° C.

(4) High-temperature Yield Strength

Exhaust members are required to have thermal deformation resistance, which makes them resistant to thermal deformation even in the repeated start (heating) and stop (cooling) of engines. To secure sufficient thermal deformation resistance, they preferably have enough high-temperature strength. The high-temperature strength can be evaluated by 0.2% yield strength at 1000° C. (high-temperature yield strength). A flanged, smooth, round rod test piece was cut out of each 1-inch Y-block sample of 50 mm in gauge distance and 10 mm in diameter, and attached to an electrohydraulic servo-type material tester (Servopulser EHF-ED10T-20L available from Shimadzu Corporation), to measure the 0.2% yield strength (MPa) of each test piece at 1000° C. in the air. The measurement results of the high-temperature yield strength in Examples 1-20 are shown in Table 3, and those in Comparative Examples 1-26 are shown in Table 4.

To exhibit sufficient heat resistance at around 1000° C., the 0.2% yield strength at 1000° C. is preferably 40 MPa or more. Exhaust members made of the heat-resistant cast steel having 0.2% yield strength of 40 MPa or more at 1000° C. have enough strength to suppress cracking and breakage even when exposed at 1000° C. under constraint. The heat-resistant, austenitic cast steel of the present invention has 0.2% yield strength of more preferably 45 MPa or more, most preferably 50 MPa or more at 1000° C.

As is clear from Table 3, the test pieces of Examples 1-20 had high-temperature yield strength of 40 MPa or more. This result indicates that the heat-resistant, austenitic cast steel of the present invention has excellent high-temperature yield strength, exhibiting sufficient high-temperature strength when used for exhaust members reaching temperatures of around 1000° C. On the other hand, the high-temperature yield strength was less than 40 MPa in any of Comparative Examples 1, 9, 11 and 20 containing too little C, Cr, Ni or N, Comparative Examples 8, 15 and 21 containing too much S, Nb or N, and Comparative Examples 17 and 19 containing too much Al. This indicates that the cast steels of Comparative Examples 1, 8, 9, 11, 15, 17 and 19-21 have insufficient high-temperature yield strength, failing to exhibit sufficient high-temperature strength when used for exhaust members reaching temperatures of around 1000° C.

(5) Thermal Fatigue Life

Exhaust members are required to have heat-cracking resistance, which makes them resistant to heat cracking even in the repeated start (heating) and stop (cooling) of engines. The heat-cracking resistance can be evaluated by a thermal fatigue life. The thermal fatigue life is evaluated by a thermal fatigue test comprising cutting a smooth, round rod test piece of 25 mm in gauge distance and 10 mm in diameter out of each 1-inch Y-block sample, attaching it to the same electrohydraulic servo-type material tester as in the above high-temperature yield strength test with a constraint ratio of 0.25, subjecting each test piece to repeated heating/cooling cycles each comprising a temperature elevation time of 2 minutes, a keeping time of 1 minute, and a cooling time of 4 minutes, 7 minutes in total, with the lowest cooling temperature of 150° C., the highest heating temperature of 1000° C., and a temperature amplitude of 850° C., in the air, thereby causing thermal fatigue breakage with elongation and shrinkage due to heating and cooling mechanically constrained.

The degree of mechanical constraint is expressed by a constraint ratio defined by [(elongation by free thermal expansion−elongation under mechanical constraint)/elongation by free thermal expansion]. For example, a constraint ratio of 1.0 means a mechanical constraint condition, in which no elongation is permitted when a test piece is heated from 150° C. to 1000° C. For example, when elongation by free expansion is 2 mm, a constraint ratio of 0.5 means a mechanical constraint condition, in which only elongation of 1 mm is permitted. Accordingly, the constraint ratio of 0.5 applies a compression load during temperature elevation, and a tensile load during temperature decrease.

Because the constraint ratios of exhaust members of actual automobile engines are about 0.1-0.5 permitting elongation to some extent, the thermal fatigue life was evaluated at a constraint ratio of 0.25.

The thermal fatigue life was defined as the number of heating/cooling cycles until the maximum tensile load measured in each cycle decreased to 75%, in a load-temperature diagram determined by load change by the repetition of heating and cooling, with the maximum tensile load in the second cycle as a reference (100%). The measurement results of thermal fatigue life in Examples 1-20 are shown in Table 3, and those in Comparative Examples 1-26 are shown in Table 4.

To have sufficient heat resistance at around 1000° C., the thermal fatigue life measured by a thermal fatigue test comprising heating and cooling at a constraint ratio of 0.25, with the highest heating temperature of 1000° C. and the temperature amplitude of 800° C. or more, is preferably 500 cycles or more. Exhaust members made of the heat-resistant cast steel having a thermal fatigue life of 500 cycles or more have excellent heat-cracking resistance, as well as long lives until thermal fatigue breakage due to cracking and deformation caused by the repeated heating and cooling of engines. The thermal fatigue life of the heat-resistant, austenitic cast steel of the present invention measured by the above thermal fatigue test is more preferably 700 cycles or more, most preferably 800 cycles or more.

As is clear from Table 3, the thermal fatigue life was 500 cycles or more in all of Examples 1-20. This result indicates that the heat-resistant, austenitic cast steel of the present invention has excellent thermal fatigue life, exhibiting sufficient heat-cracking resistance when used for exhaust members repeatedly subjected to heating to temperatures of around 1000° C. and cooling. As is clear from Table 4, however, the thermal fatigue life was less than 500 cycles in any of Comparative Examples 3 and 14 containing too little Si or Nb. This indicates that the cast steels of Comparative Examples 3 and 14 fail to exhibit sufficient thermal fatigue life when used for exhaust members reaching temperatures of around 1000° C.

(6) Room-temperature Elongation

Exhaust members are required to have thermal deformation resistance, which makes them resistant to thermal deformation in the repeated start (heating) and stop (cooling) of engines. To secure sufficient thermal deformation resistance, they preferably have high ductility in addition to enough high-temperature yield strength. To evaluate the ductility, a flanged, smooth, round rod test piece of 50 mm in gauge distance and 10 mm in diameter was cut out of each 1-inch Y-block sample, and attached to the same electrohydraulic servo-type material tester as in the above high-temperature yield strength test, to measure the room-temperature elongation (%) of each test piece at 25° C. in the air. The measurement results of room-temperature elongation in Examples 1-20 are shown in Table 3, and those in Comparative Examples 1-26 are shown in Table 4.

The heat-resistant, austenitic cast steel of the present invention preferably has room-temperature elongation of 2.0% or more. Exhaust members made of the heat-resistant cast steel having room-temperature elongation of 2.0% or more has enough ductility to suppress deformation and cracking caused by tensile stress turned from compression stress generated at high temperatures, when cooled from high temperatures to nearly room temperature. Also, such exhaust members are resistant to cracking and breakage even under mechanical vibration and shock during production, assembling in engines, the start and driving of automobiles, etc. The room-temperature elongation of the heat-resistant, austenitic cast steel of the present invention is more preferably 4.0% or more, most preferably 6.0% or more.

As is clear from Table 3, the room-temperature elongation was 2.0% or more in all of Examples 1-20. This result indicates that the heat-resistant, austenitic cast steel of the present invention has excellent room-temperature elongation, and exhibits sufficient thermal deformation resistance when used for exhaust members repeatedly heated and cooled. As is clear from Table 4, however, the room-temperature elongation was less than 2.0% in Comparative Example 20 containing too little N, Comparative Examples 2, 8, 10, 12, 15 and 21 containing too much C, S, Cr, Ni, Nb or N, and Comparative Examples 17 and 19 containing too much Al. This indicates that the cast steels of Comparative Examples 2, 8, 10, 12, 15, 17 and 19-21 have insufficient room-temperature elongation, failing to exhibit sufficient thermal deformation resistance when used for exhaust members repeatedly heated and cooled.

As described above, it was found that the heat-resistant, austenitic cast steel of the present invention has heat resistance (oxidation resistance, high-temperature strength, heat-cracking resistance and thermal deformation resistance) required on exhaust members reaching temperatures of around 1000° C., as well as good machinability.

TABLE 3

| No. | Area Ratio of Sulfide Particles (%)(1) | Tool Life (minutes) | Weight Reduction by Oxidation (mg/cm$^2$) | High-Temperature Yield Strength (MPa) | Thermal Fatigue Life (cycles) | Room-Temperature Elongation (%) |
|---|---|---|---|---|---|---|
| Example 1 | 66 | 38 | 10 | 45 | 815 | 7.8 |
| Example 2 | 61 | 27 | 12 | 48 | 832 | 5.6 |
| Example 3 | 82 | 58 | 9 | 55 | 750 | 6.7 |
| Example 4 | 81 | 56 | 11 | 56 | 762 | 6.5 |
| Example 5 | 90 | 60 | 9 | 55 | 807 | 6.1 |
| Example 6 | 84 | 57 | 11 | 61 | 802 | 7.2 |
| Example 7 | 87 | 59 | 10 | 59 | 818 | 7.5 |
| Example 8 | 83 | 60 | 10 | 49 | 806 | 8.2 |
| Example 9 | 68 | 39 | 10 | 50 | 782 | 8.4 |
| Example 10 | 69 | 32 | 11 | 46 | 762 | 8.5 |
| Example 11 | 72 | 43 | 8 | 66 | 578 | 2.4 |
| Example 12 | 70 | 41 | 6 | 59 | 565 | 2.6 |
| Example 13 | 68 | 28 | 5 | 62 | 613 | 3.7 |
| Example 14 | 74 | 49 | 12 | 45 | 765 | 8.1 |
| Example 15 | 91 | 63 | 14 | 49 | 772 | 8.3 |
| Example 16 | 66 | 34 | 12 | 48 | 665 | 2.5 |
| Example 17 | 83 | 56 | 8 | 48 | 696 | 8.5 |
| Example 18 | 60 | 25 | 9 | 47 | 626 | 2.1 |
| Example 19 | 89 | 63 | 11 | 49 | 792 | 8.6 |
| Example 20 | 80 | 52 | 12 | 42 | 696 | 8.5 |

Note:
(1)The area ratio of sulfide particles having equivalent circle diameters of 2 μm or more to all sulfide particles.

TABLE 4

| No | Area Ratio of Sulfide Particles (%)(1) | Tool Life (minutes) | Weight Reduction by Oxidation (mg/cm$^2$) | High-Temperature Yield Strength (MPa) | Thermal Fatigue Life (cycles) | Room-Temperature Elongation (%) |
|---|---|---|---|---|---|---|
| Com. Ex. 1 | 61 | 26 | 10 | 34 | 762 | 6.9 |
| Com. Ex. 2 | 64 | 24 | 12 | 52 | 652 | 1.8 |
| Com. Ex. 3 | 68 | 42 | 32 | 51 | 453 | 3.2 |
| Com. Ex. 4 | 59 | 20 | 11 | 45 | 640 | 6.4 |
| Com. Ex. 5 | 50 | 18 | 12 | 52 | 742 | 6.7 |
| Com. Ex. 6 | 62 | 28 | 36 | 49 | 716 | 7.2 |

TABLE 4-continued

| No | Area Ratio of Sulfide Particles (%)[1] | Tool Life (minutes) | Weight Reduction by Oxidation ($mg/cm^2$) | High-Temperature Yield Strength (MPa) | Thermal Fatigue Life (cycles) | Room-Temperature Elongation (%) |
|---|---|---|---|---|---|---|
| Com. Ex. 7 | 48 | 5 | 10 | 50 | 708 | 7.4 |
| Com. Ex. 8 | 63 | 26 | 10 | 28 | 718 | 1.8 |
| Com. Ex. 9 | 63 | 23 | 41 | 32 | 776 | 6.7 |
| Com. Ex. 10 | 57 | 16 | 6 | 55 | 525 | 1.6 |
| Com. Ex. 11 | 65 | 36 | 15 | 38 | 621 | 7.2 |
| Com. Ex. 12 | 64 | 18 | 9 | 74 | 531 | 2.4 |
| Com. Ex. 13 | 60 | 23 | 23 | 82 | 552 | 2.1 |
| Com. Ex. 14 | 68 | 22 | 26 | 46 | 485 | 4.2 |
| Com. Ex. 15 | 58 | 18 | 12 | 38 | 653 | 1.2 |
| Com. Ex. 16 | 46 | 21 | 11 | 45 | 642 | 6.3 |
| Com. Ex. 17 | 75 | 22 | 13 | 37 | 640 | 1.5 |
| Com. Ex. 18 | 43 | 12 | 7 | 62 | 520 | 2.3 |
| Com. Ex. 19 | 78 | 15 | 13 | 38 | 586 | 0.5 |
| Com. Ex. 20 | 63 | 24 | 11 | 32 | 528 | 1.5 |
| Com. Ex. 21 | 60 | 8 | 14 | 30 | 702 | 0.8 |
| Com. Ex. 22 | 55 | 22 | 10 | 52 | 621 | 6.6 |
| Com. Ex. 23 | 58 | 21 | 10 | 52 | 613 | 6.6 |
| Com. Ex. 24 | 72 | 18 | 12 | 42 | 647 | 6.2 |
| Com. Ex. 25 | 73 | 16 | 12 | 42 | 622 | 6.2 |
| Com. Ex. 26 | 69 | 15 | 8 | 52 | 586 | 2.1 |

Note:
[1]The area ratio of sulfide particles having equivalent circle diameters of 2 μm or more to all sulfide particles.

EFFECTS OF THE INVENTION

Because the heat-resistant, austenitic cast steel of the present invention has excellent heat resistance at around 1000° C. and good machinability, it provides cutting tools with long lives at high cutting speeds, improving cutting productivity and providing economic advantages. The heat-resistant, austenitic cast steel of the present invention having such feature can be used to efficiently produce exhaust members for automobiles at low cost.

What is claimed is:

1. A heat-resistant, austenitic cast steel, which consists of by mass 0.4-0.55% of C,
1-2% of Si,
0.5-1.5% of Mn,
18-27% of Cr,
8-22% of Ni,
1.5-2.5% of Nb,
0.01-0.3% of N,
0.1-0.2% of S, and
0.02-0.15% of Al, the balance being Fe and inevitable impurities;

a machinability index I expressed by the following formula:

$$I=100\times S+75\times Al+0.75\times Mn-10\times C-2\times Nb-0.25\times Cr-0.15\times Ni-1.2\times N,$$

wherein each element symbol represents % by mass of each element in the cast steel, meeting the condition of $-3.0\leq I\leq +14.0$.

2. The heat-resistant, austenitic cast steel according to claim 1, which has a structure, in which the area ratio of sulfide particles having equivalent circle diameters of 2 μm or more to all sulfide particles is 60% or more.

3. The heat-resistant, austenitic cast steel according to claim 1, wherein when it is milled with a cemented carbide tool at a cutting speed of 150 m/minute, a feed of 0.2 mm/tooth, and a cutting depth of 1.0 mm, under a dry condition without a cutting liquid, a tool life expressed by cutting time until the flank wear of the cemented carbide tool reaches 0.2 mm is 25 minutes or more.

4. An exhaust member made of the heat-resistant, austenitic cast steel recited in claim 1.

* * * * *